US005720644A

United States Patent [19]

Ku

[11] Patent Number: 5,720,644

[45] Date of Patent: Feb. 24, 1998

[54] VOICE-ACTUATED SPHERICAL TUMBLER

[76] Inventor: Wane Ming Ku, P.O. Box 82-144, Taipei, Taiwan

[21] Appl. No.: 743,341

[22] Filed: Nov. 4, 1996

[51] Int. Cl.[6] ..... A63H 30/00; A63H 15/00; A63H 29/08

[52] U.S. Cl. ..... 446/175; 446/351; 446/458; 473/594

[58] Field of Search ..... 446/175, 351, 446/437, 458, 462; 473/571, 594

[56] References Cited

U.S. PATENT DOCUMENTS

| | | | |
|---|---|---|---|
| 819,609 | 5/1906 | Shorthouse | 446/458 |
| 2,780,029 | 2/1957 | Anthony | 473/571 |
| 3,798,835 | 3/1974 | McKeehan | 446/458 |
| 4,726,800 | 2/1988 | Kobayashi | 446/458 |
| 5,356,326 | 10/1994 | Ting | 446/175 |
| 5,370,569 | 12/1994 | Mo-Hsin | 446/175 |

FOREIGN PATENT DOCUMENTS

| | | | |
|---|---|---|---|
| 917238 | 8/1954 | Germany | 446/458 |

*Primary Examiner*—Robert A. Hafer
*Assistant Examiner*—Laura Fossum
*Attorney, Agent, or Firm*—A & J

[57] ABSTRACT

A voice-actuated spherical tumbler including two hollow semi-spherical shells connected into a spherical housing, a mounting plate fixedly mounted inside one semi-spherical shell, a rocker supported on a spring to hold a weight, a voice-controlled circuit board, a motor controlled by the voice-controlled circuit board to turn the rocker, causing it to shift the center of gravity of the tumbler.

3 Claims, 4 Drawing Sheets

VOICE-ACTUATED SPHERICAL TUMBLER

BACKGROUND OF THE INVENTION

1. Field of the Invention

This invention relates to toy tumblers, and relates more specifically to a voice-actuated spherical tumbler.

2. Description of the Prior Art

Conventional toy tumblers have a fixed center of gravity near the bottom side, therefore they do not fall when they are forced to oscillate. These toy tumblers have different designs to attract people. However, these toy tumblers do not attract people for long because they all work in the same manner.

SUMMARY OF THE INVENTION

This invention relates to toy tumblers, and relates more specifically to a voice-actuated spherical tumbler.

According to the present invention, the voice-actuated spherical tumbler comprises a spherical housing which comprises a hollow semi-spherical upper shell and a hollow semi-spherical bottom shell connected together by a screw joint, the hollow semi-spherical upper shell having a top plane on the outside, the hollow semi-spherical bottom shell having a mounting plate fixedly mounted on the inside; a motor mounted on the mounting plate at a top side thereof; upright support means raised from the mounting plate; a rocker having a bottom end pivoted to the upright support means and coupled to the motor, an annular groove around the periphery in the middle, and a top end; a weight mounted on the top end of the rocker; an upright spring holder raised from the top side of the mounting plate; spring means having one end connected to the upright spring holder and an opposite end connected to the annular groove of the rocker; battery power supply means mounted on the mounting plate to provide the necessary working power supply to the motor; a voice-controlled circuit board mounted on the mounting plate at a bottom side thereof and controlled by voice to drive the motor, causing the weight to be moved with the rocker to shift the center of gravity of the tumbler.

DETAILED DESCRIPTION OF THE PREFERRED EMBODIMENT

Figure 1:
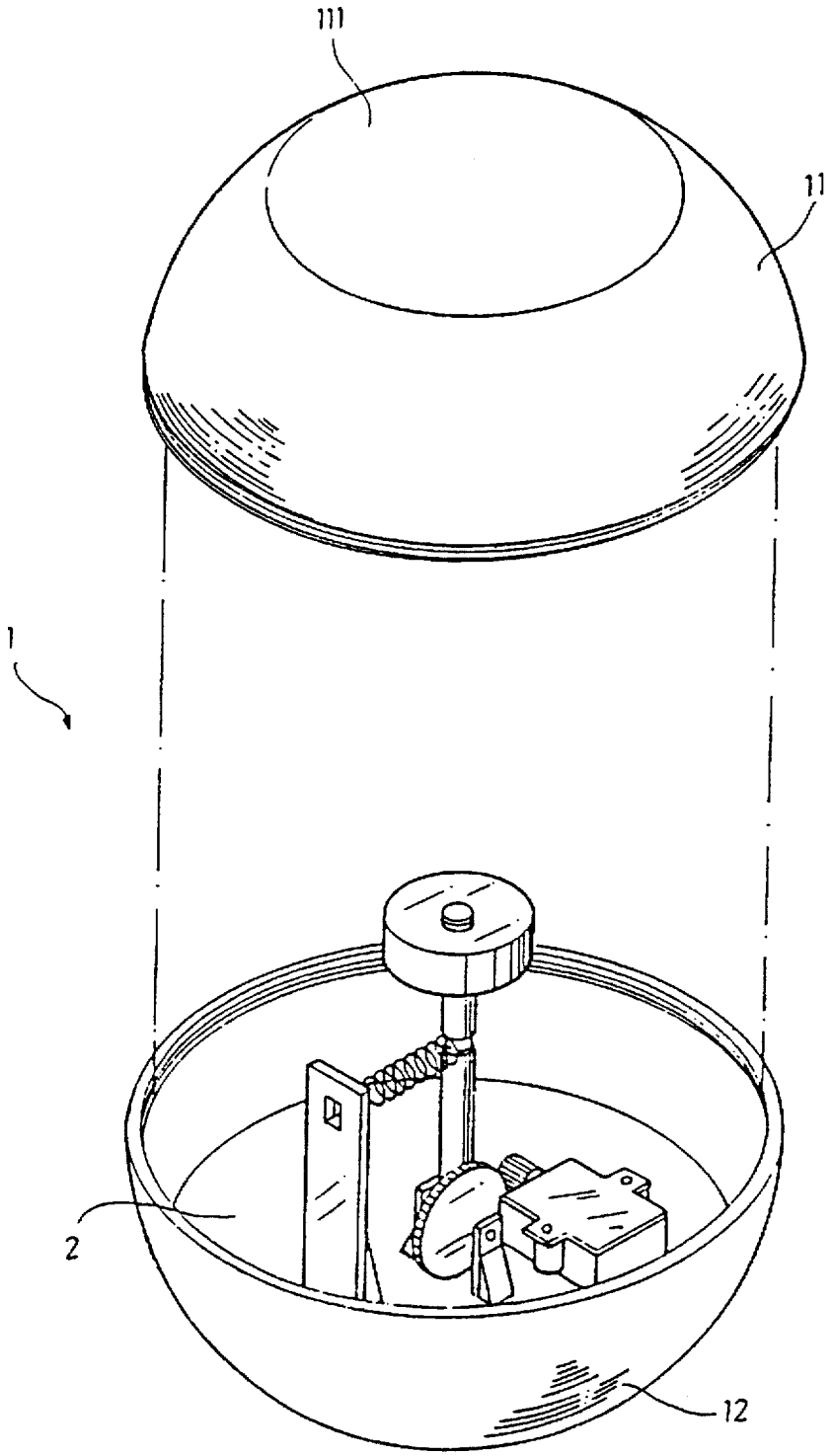
FIG. 1 is an elevational view of a voice-actuated semi-spherical tumbler according to the present invention, showing the hollow semi-spherical shell opened.

For the purpose of promoting an understanding of the principles of the invention, reference will now be made to the embodiment illustrated in the drawings. Specific language will be used to describe same. It will, never-the-less, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, a voice-actuated spherical tumbler in accordance with the present invention, comprises a spherical housing 1. The spherical housing 1 is comprised of a hollow semi-spherical upper shell 11 and a hollow semi-spherical bottom shell 12 connected together by a screw joint. The hollow semi-spherical upper shell 11 has a top plane 111 on the outside. The hollow semi-spherical bottom shell 12 is fixedly mounted with a circular mounting plate 2 on the inside.

Figure 2:
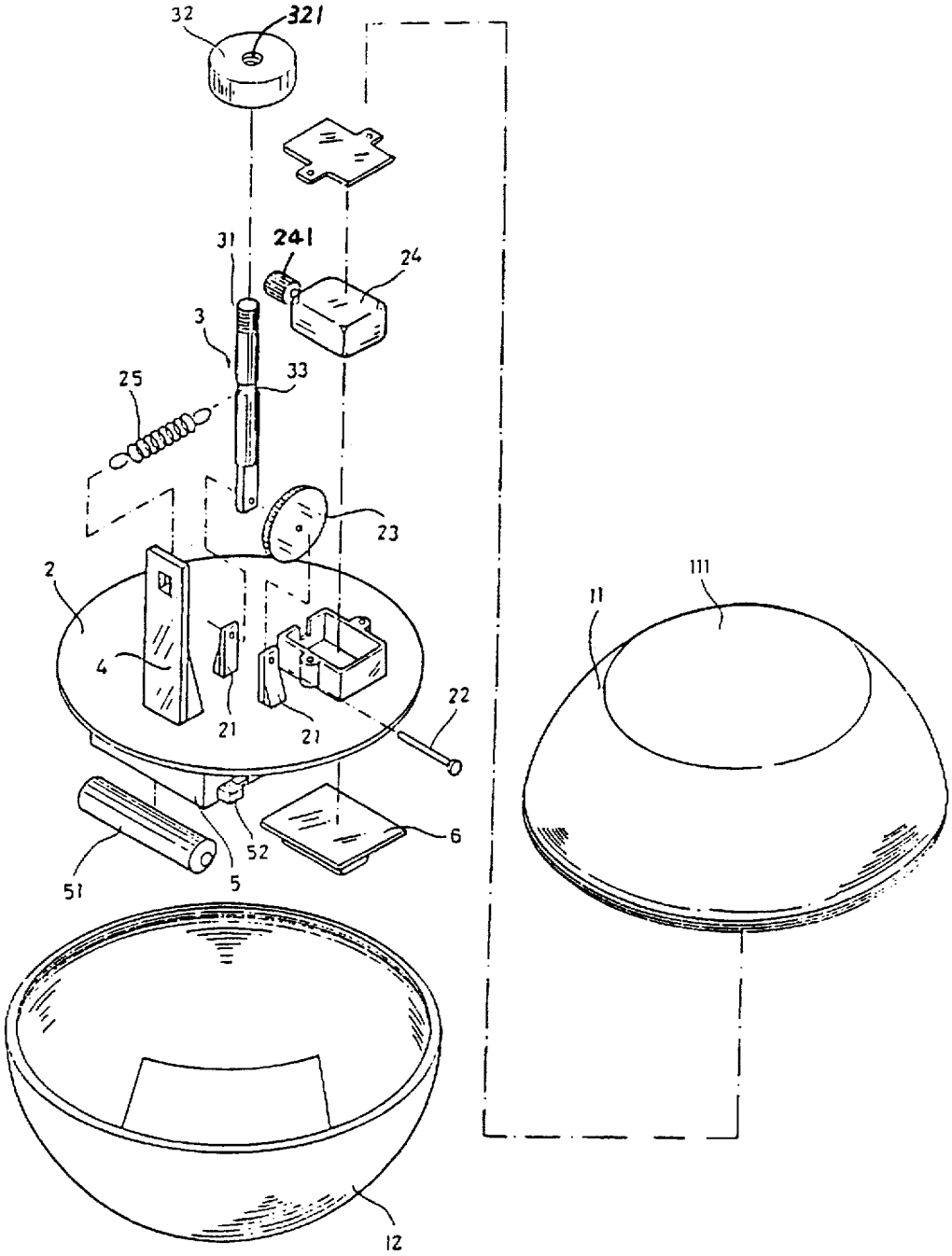
FIG. 2 is an exploded view of the voice-actuated spherical tumbler shown in FIG. 1.
Figure 3:
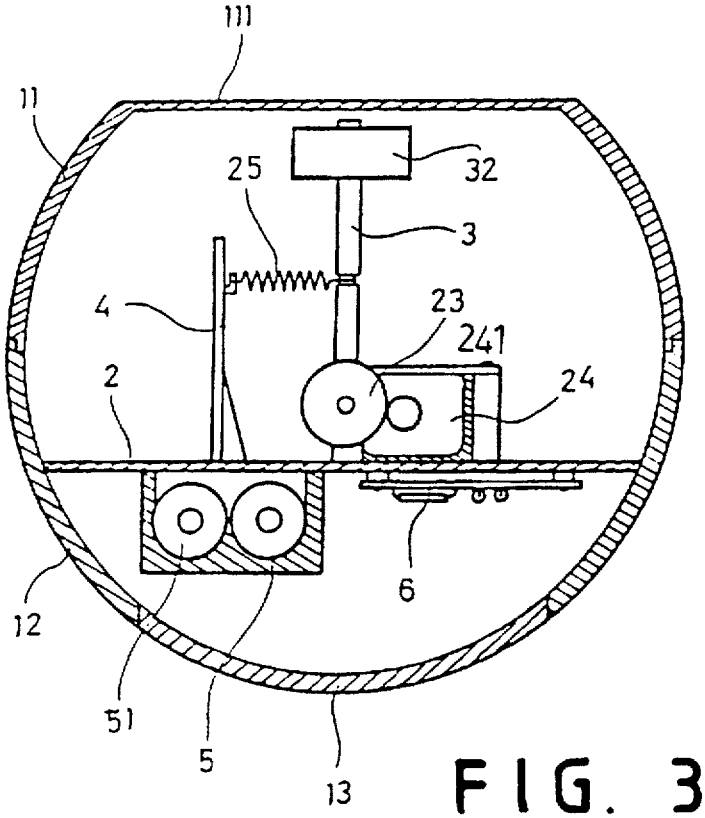
FIG. 3 is a sectional view of the present invention when not operated.

Referring to FIGS. 2 and 3, a pair of upright supports 21 are disposed at the top of the circular mounting plate 2 to hold a rocker 3 and a gear 23. The rocker 3 has a bottom end pivotably connected to the upright supports 21 by a pivot 22, an annular groove 33 around the periphery in the middle, and a top end terminating in an outer thread 31. The gear 23 is revolvably mounted around the pivot 22 and fixedly secured to the bottom end of the rocker 3 at one side. A motor 24 is fixedly mounted on the circular mounting plate 2 at the top adjacent to the upright pivots 21, having a pinion 241 fixedly mounted around the output shaft thereof and meshed with the gear 23. A weight 32 is provided having an inner thread 321 at its center of gravity threaded onto the outer thread 31 of the rocker 3. An upright spring holder 4 is raised from the circular mounting plate 2 at one side of the upright supports 21 opposite to the motor 24 to hold a compression spring 25. The compression spring 25 has one end connected to the upright spring holder 4, and an opposite end secured to the annular groove 33 of the rocker 3. A battery case 5 is fixedly fastened to the bottom side of the circular mounting plate 2 to hold a battery 51. The hollow semi-spherical bottom shell 12 has a lid 13. When the lid 13 is opened, the battery 51 can be taken out of the battery case 5 and the hollow semi-spherical bottom shell 12 for a replacement. Furthermore, a voice-controlled circuit board 6 is mounted on the bottom side of the circular mounting plate 2 at a suitable location, having a power input end connected to the power output end of the battery case 5, and a signal output end connected to the motor 24. When the voice-controlled circuit board 6 receives a voice signal for example an applause, it immediately drives the motor 24.

Figure 4:
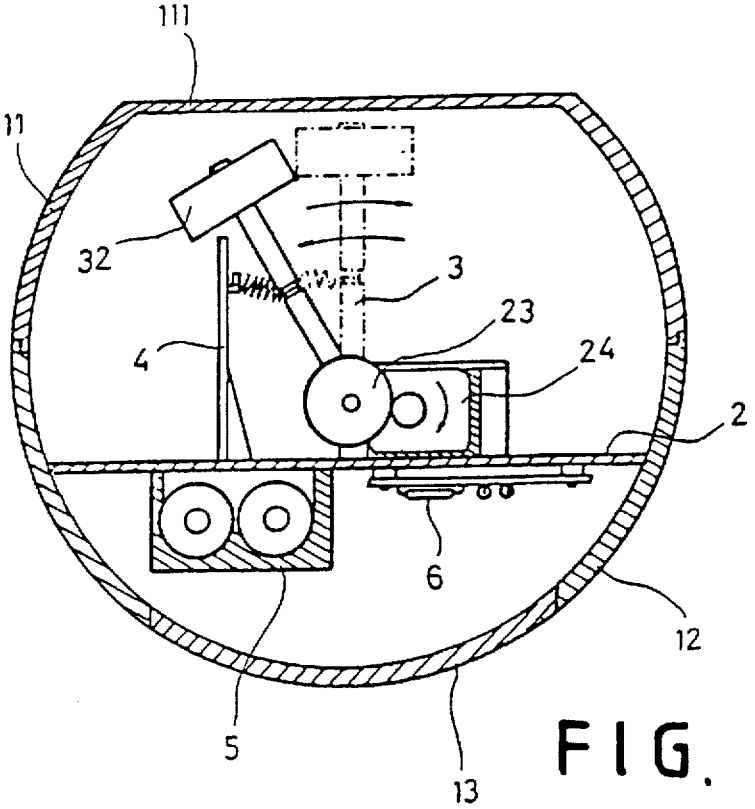
FIG. 4 is another sectional view of the present invention, showing the rocker turned leftwards, and the compression spring compressed.
Figure 5:
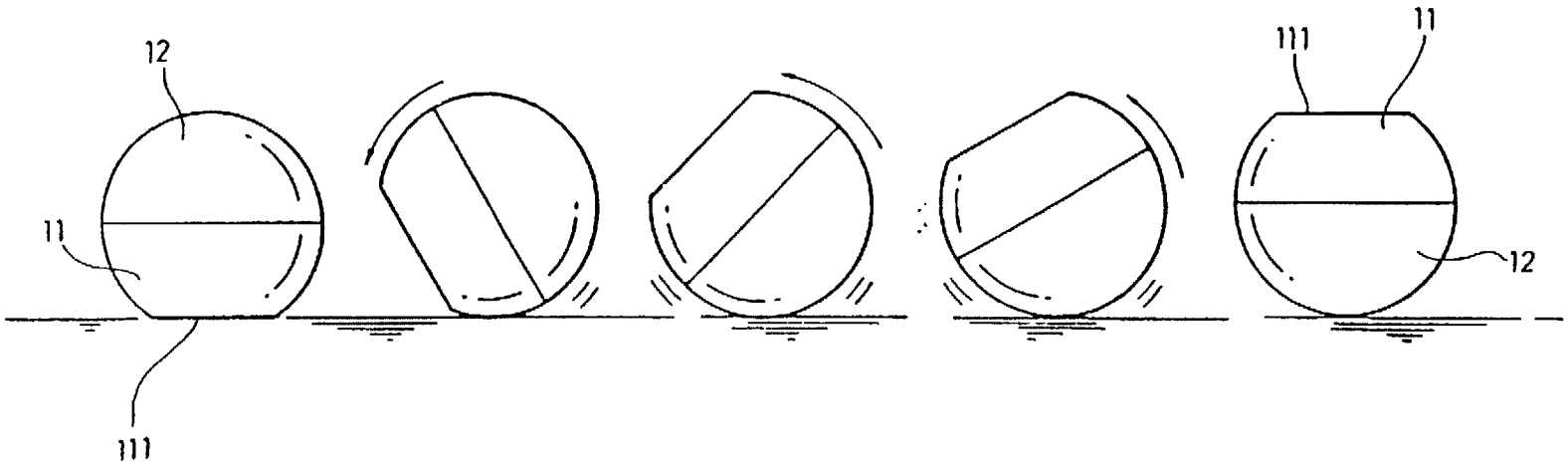
FIG. 5 is a schematic drawing showing the voice-actuated spherical tumbler turned to different positions.

Referring to FIGS. 4 and 5, when the user produces an applause, the voice-controlled circuit board 6 is triggered to drive the motor 24, thereby causing the pinion 241 to turn the gear 23. When the gear 23 is rotated, the rocker 3 is turned about the pivot 22 towards the upright spring holder 4 to compress the compression spring 25, and at the same time the weight 32 is moved leftwards with the rocker 3 to shift the center of gravity of the tumbler, thereby causing the spherical housing 1 to turn leftwards. When the applause is disappeared, the motor 24 is stopped from operation, and the compression spring 25 immediately pushes the rocker 3 back to its former position, and therefore the center of gravity of the tumbler is shifted back to its original point. At this moment, the tumbler keeps oscillating. If the frequency of the sound source matches the oscillation of the tumbler, the amplitude of the oscillation of the tumbler will be gradually increased until the housing 1 is turned upside-down with the top plane 111 of the hollow semi-spherical shell 11 supported on the playing surface.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A voice-actuated spherical tumbler comprising:

a spherical housing, said spherical housing comprising a hollow semi-spherical upper shell and a hollow semi-spherical bottom shell connected together by a screw joint, said hollow semi-spherical upper shell having a top plane on the outside, said hollow semi-spherical bottom shell having a mounting plate fixedly mounted on the inside;

a motor mounted on said mounting plate at a top side thereof;

upright support means raised from said mounting plate;

a rocker having a bottom end pivoted to said upright support means and coupled to said motor, an annular groove around the periphery in the middle, and a top end;

a weight mounted on the top end of said rocker;

an upright spring holder raised from the top side of said mounting plate;

spring means having one end connected to said upright spring holder and an opposite end connected to the annular groove of said rocker;

battery power supply means mounted on said mounting plate to provide the necessary working power supply to said motor;

a voice-controlled circuit board mounted on said mounting plate at a bottom side thereof and controlled by voice to drive said motor, causing said weight to be moved with said rocker to shift the center of gravity of the tumbler.

2. The voice-actuated spherical tumbler as claimed in claim 1, wherein the top end of said rocker has an outer thread, said weight has an inner thread threaded onto the outer thread of said rocker.

3. The voice-actuated spherical tumbler as claimed in claim 1, wherein a transmission gear is fixedly fastened to the bottom end of said rocker; said motor has a pinion fixedly mounted around an output shaft thereof and meshed with said transmission gear.

* * * * *